US005660532A

United States Patent [19]

Castel

[11] Patent Number: 5,660,532

[45] Date of Patent: Aug. 26, 1997

[54] MULTIPHASE PISTON-TYPE PUMPING SYSTEM AND APPLICATIONS OF THIS SYSTEM

[75] Inventor: Yvon Castel, Croissy sur Seine, France

[73] Assignee: Institut Francais du Petrole, Rueil Malmaison, France

[21] Appl. No.: 797,894

[22] Filed: Nov. 26, 1991

Related U.S. Application Data

[63] Continuation of Ser. No. 465,101, Feb. 16, 1990.

[30] Foreign Application Priority Data

May 2, 1988 [FR] France ..... 88 05959

[51] Int. Cl.[6] ..... F04B 39/10

[52] U.S. Cl. ..... 417/342; 417/562; 92/248

[58] Field of Search ..... 417/562, 567, 417/571, 439, 342, 346, 347; 92/172, 85 B, 85 R, 248

[56] References Cited

U.S. PATENT DOCUMENTS

| | | | |
|---|---|---|---|
| 309,904 | 12/1884 | Weimer | 417/562 |
| 2,213,256 | 9/1940 | Paget | 417/562 |
| 2,213,257 | 9/1940 | Lamberton | 417/562 |
| 2,312,883 | 3/1943 | Demann | 417/562 |
| 2,404,079 | 7/1946 | Maniscalco et al. | 417/439 |
| 2,763,425 | 9/1956 | Sahle | 417/562 |
| 2,966,861 | 1/1961 | Stewart et al. | 417/562 |
| 3,487,897 | 1/1970 | Hahm et al. | 92/248 |
| 4,611,634 | 9/1986 | Krückewitt | 92/85 B |
| 4,790,728 | 12/1988 | Dwyer | 417/342 |

FOREIGN PATENT DOCUMENTS

| | | | |
|---|---|---|---|
| 2426378 | 1/1975 | Germany | 417/562 |
| 3304341 | 8/1984 | Germany | 417/562 |

*Primary Examiner*—Timothy Thorpe
*Assistant Examiner*—Ted Kim
*Attorney, Agent, or Firm*—Antonelli, Terry, Stout & Kraus, LLP

[57] ABSTRACT

A multiphase piston-type pumping system including a feed line (13) for the fluid to be pumped and a discharge line (19) for the pumped fluid, with at least one first variable-volume chamber (2) designed for pumping, the fluid, and with chamber being defined by a first cylinder head (3), a first cylinder (4), and a first piston (5), whereby piston (5) moves along the longitudinal axis of cylinder (4) in the cylinder (4). A first drive element (6) moves the piston (5) in the cylinder (4). The system also has a casing (23) surrounding at least the space swept by piston (5), with the space being opposite the first chamber (2) with respect to and with the piston (5), said easing (23) containing a gaseous fluid. The piston (5) has a recess (20) designed to receive a projection (10) integral with cylinder head (3), whereby these two elements produce a jet of fluid directed at a discharge port (15).

33 Claims, 4 Drawing Sheets

MULTIPHASE PISTON-TYPE PUMPING SYSTEM AND APPLICATIONS OF THIS SYSTEM

CROSS-REFERENCE TO RELATED APPLICATION

This application is a continuation of U.S. application Ser. No. 07/465,101, filed Feb. 16, 1990, now abandoned.

BACKGROUND OF THE INVENTION

1. Field of the Invention

The invention relates to a pumping system for a multiphase fluid that is particularly suited for production of hydrocarbons in environments where human intervention is difficult or even impossible and where one of the requirements is high equipment reliability.

The invention applies in particular to production of hydrocarbons from at least one submerged wellhead in a field such as an offshore field, the hydrocarbons being a multiphase mixture, generally gas-liquid hydrocarbon-water, under pressure.

The invention also applies in particular to production of hydrocarbons from at least one wellhead located in an environment to which access is difficult, such as in virgin forest in remote locations.

The device according to the invention allows, in particular, pumping of a liquid phase and a gas phase in a single pipe and hence avoids the use of a phase separator and two separate pipes for transporting the pumped fluids separately.

The device according to the invention is also suitable for pumping a multiphase fluid including a dispersed solid phase, such as sand or rock debris while effectively evacuating all of the multiple phase constituents without the formation of solid particle deposits in the bottom of a pumping chamber having a head, cylinder and reciprocating piston.

2. Description of the Prior Art

The use of rotary multiphase compressor pumps is known, but their cost is very high and their efficiency is moderate, particularly because of substantial friction losses. These losses are linked to the high rotational speed and to the throughput, among other factors.

The device according to the present invention allows multiphase fluids to be pumped while retaining good efficiency while preventing the formation of solid particle deposits on a bottom of a pumping chamber having a head, cylinder and a sliding piston.

SUMMARY OF THE INVENTION

The multiphase fluid pumping device according to the invention has, in combination, a feed line for the fluid to be pumped and a discharge line for the pumped fluid, at least one first variable-volume chamber designed for pumping the fluid, with this chamber being defined by a first cylinder head, a first cylinder, and a first piston. The piston moves along a longitudinal axis of the cylinder within the cylinder. The device according to the invention also includes a first drive element designed to move the piston in the cylinder, and a casing surrounding at least the volume swept by the piston, with the volume being disposed opposite to the chamber with respect to the piston. This casing contains a multiple phase fluid including liquid, gaseous and particular constituents.

The first drive element may be a first hydraulic jack.

The device according to the invention may include a second variable-volume chamber designed to pump the fluid. The second chamber is defined by a second cylinder head, a second cylinder, and a second piston. The second piston moves along a longitudinal axis of the second cylinder in the second cylinder. The casing also surrounds the volume swept by the second piston, with this space being opposite the second chamber with respect to the second piston.

The movements of at least the first and second pistons are designed such that the pressure of the fluid in the casing is essentially constant. This device may also have a second hydraulic jack, the first jack being integral with the first piston and the second jack being integral with the second piston. In addition, it may include means for controlling the first and the second jack designed to reduce the volume of the first chamber while increasing the volume of the second chamber and designed to reduce the volume of the second chamber while increasing the volume of the first chamber, alternately.

The control means may trigger the increase in volume of one of the two chambers only if the other of the two chambers has reached its maximum volume, and the control may trigger a reduction in the volume of one chamber only if the other of the two chambers has reached its maximum volume.

The device according to the invention may include a high-pressure generator supplying a hydraulic fluid at high pressure and a low-pressure generator supplying a hydraulic fluid at a pressure less than the high pressure, with the high-pressure generator supplying each of the jacks when they are producing a reduction in volume of their respective chambers, and with the low-pressure generator supplying each of the jacks when they are producing an increase in volume of their respective chambers.

The casing according to the invention may be closed and communicate only with the intake line or only with the discharge line.

The device according to the invention may have the first or the second jack which includes a body, with the body being able to be at least partially outside the casing.

The device according to the invention may include several pumping chambers, but even in number. The casing may be fluid-tight.

The above device may advantageously be applied to the pumping of petroleum effluents, in particular to aquatic production of these effluents such as offshore production, the device being located at the bottom of an aqueous medium, as well as land production in a hostile environment.

The present invention also relates to a device for pumping a multiphase fluid which has, in combination, a feed line for the fluid to be pumped and a discharge line for the pumped fluid, and at least one variable-volume chamber suitable for pumping the fluid, with the chamber being defined by a cylinder head, a cylinder, and a piston.

The piston moves along the longitudinal axis of the cylinder in the cylinder. The piston has a recess facing an upper part of the piston, and the cylinder head has a splayed projection which penetrates into the recess when the piston is approaching the cylinder head. The piston and the cylinder head cooperate to produce a jet of fluid with a velocity sufficient to evaluate particles within the multiple phase fluid from forming deposits on a bottom of a chamber having a head, cylinder and a reciprocating piston directed toward at least one exhaust port for the multiphase fluid with the velocity of the multiphase fluid preferably increasing as the piston having a recess complementary to the splayed cylinder head moves toward the splayed cylinder head with a velocity sufficient to evacuate splayed particles within the multiple phase fluid from forming deposits on a bottom of a chamber having a head, cylinder and a reciprocating piston.

The recess and the projection may have substantially matching frustroconical shapes. The recess and the projection may be disposed in the vicinity of the axis of the cylinder.

The chamber may have a fluid feed port located at a tip of the projection. The cylinder head may have at least two exhaust ports disposed at substantially equal distances from the axis of the cylinder.

BRIEF DESCRIPTION OF THE DRAWINGS

The complementary shapes of the splayed projection of the head and the recess of the piston are chosen such that the splayed configuration extends over a substantial part of the height of the recess, e.g. more than one-half the total height, with a largest cross-sectional area of the splayed projection being located closest to and adjacent to the top portion of the cylinder head which does not project into the chamber in which the piston reciprocates.

When the aforementioned complementary geometry exists between the splayed projection and the recess in the reciprocating piston, an annular section is defined by an internal wall of the piston and the shape of the protrusion which, for a given speed of reciprocation of the piston, decreases in surface area during the course of movement of the piston toward the splayed protrusion which produces an increase in velocity of the jet of multiple phase fluid comprised of gas, liquid and particulate constituents produced by the stroke of the piston toward the cylinder head. The highest velocity of the jet is obtained when the diameter of the radius of the splayed protrusion flush with the opening of the recess in the piston has reached a maximum which occurs when the area of the aforementioned annular section has reached a minimum.

Figure 1:
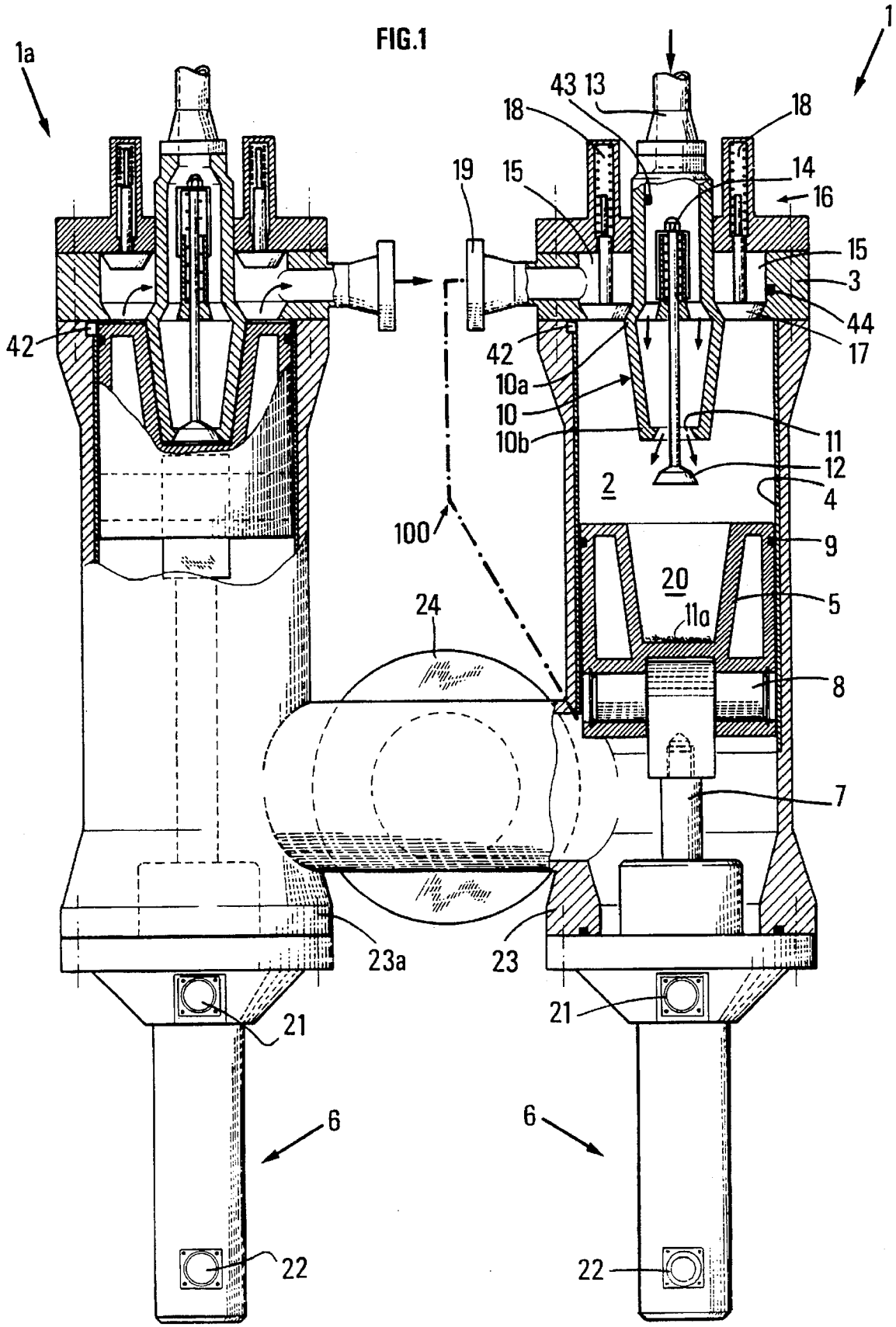
Figure 2:
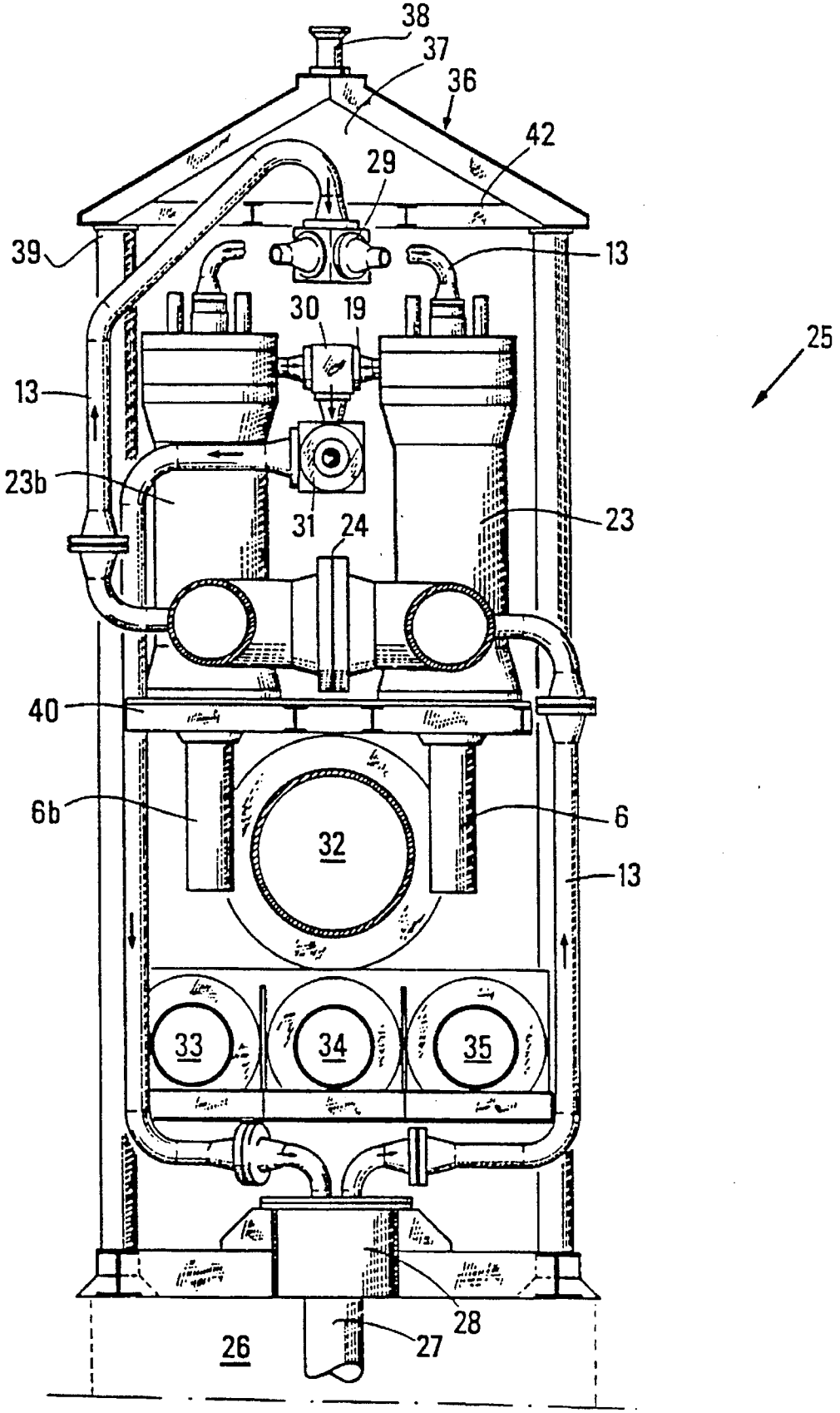
Figure 3:
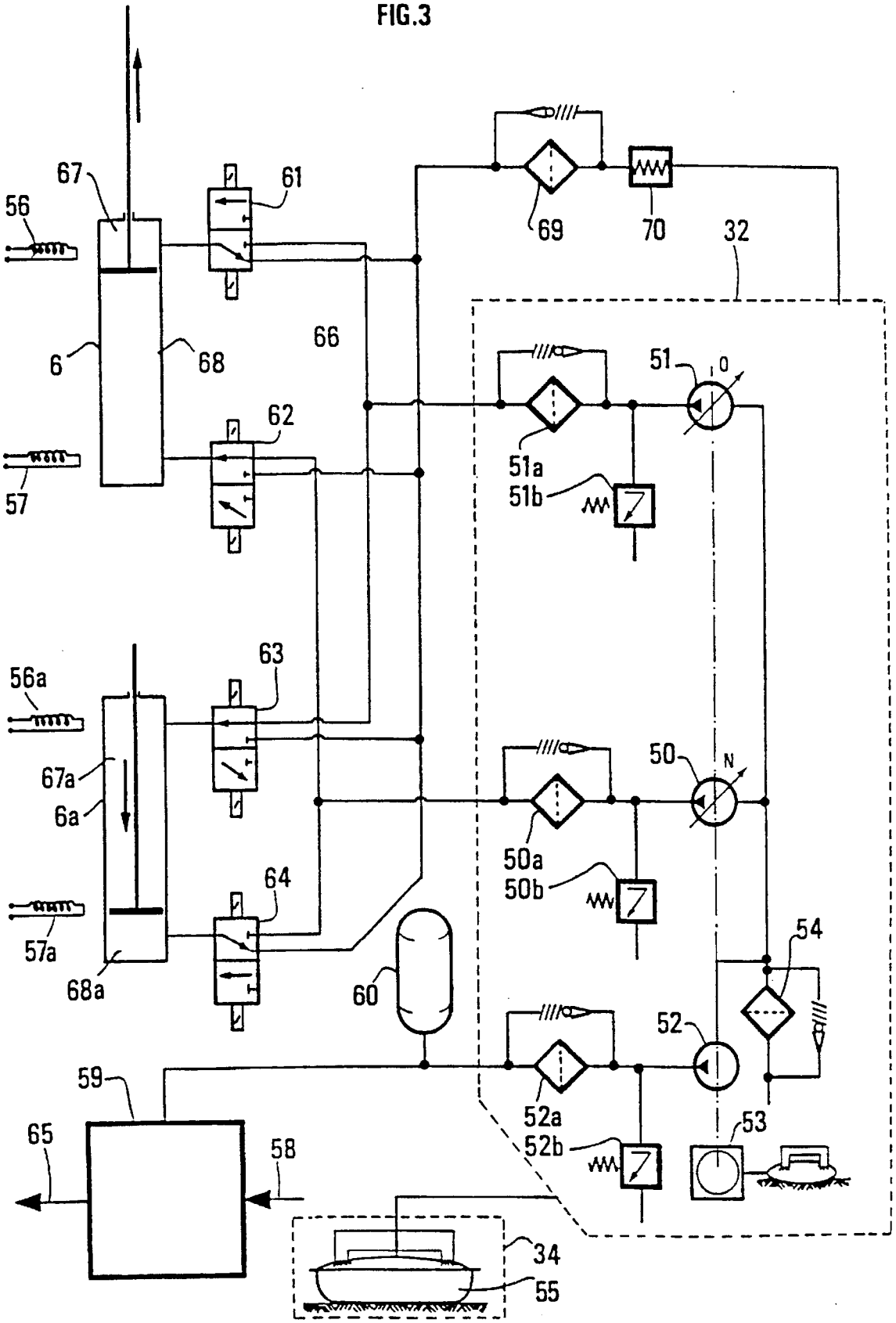
Figure 6:
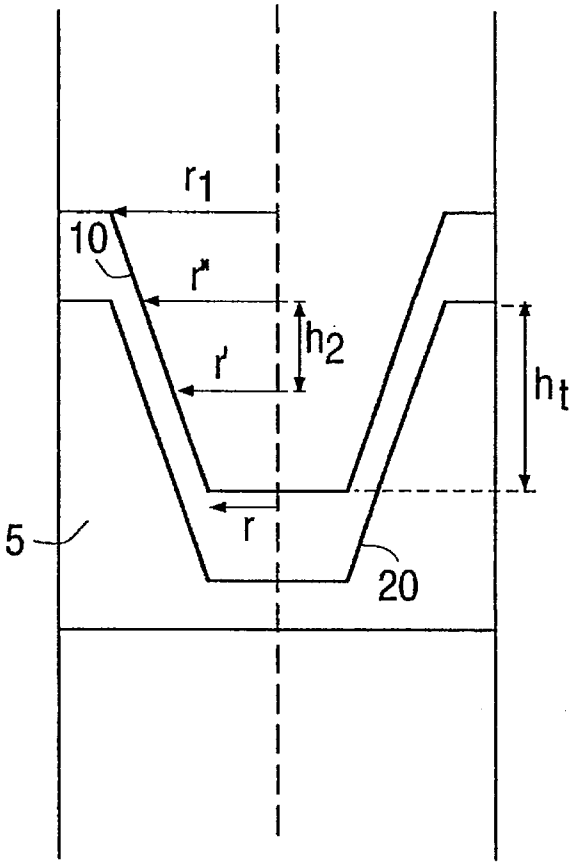
Figure 5:
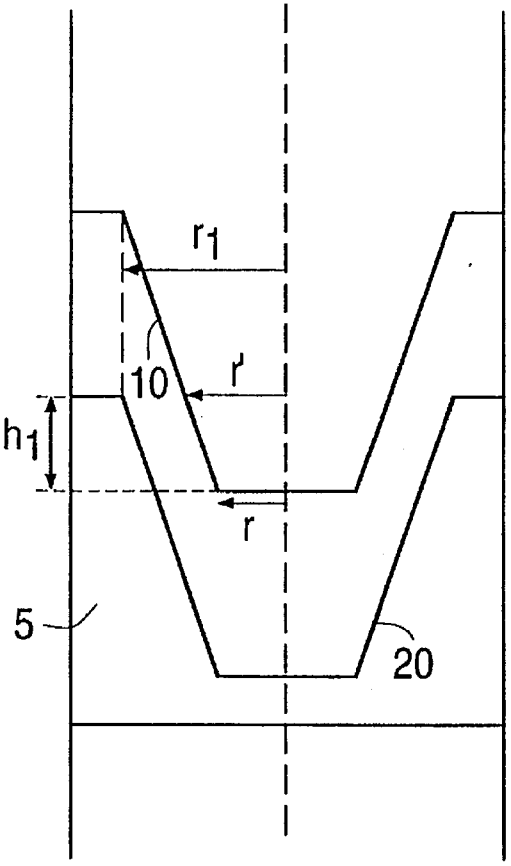
Figure 4:
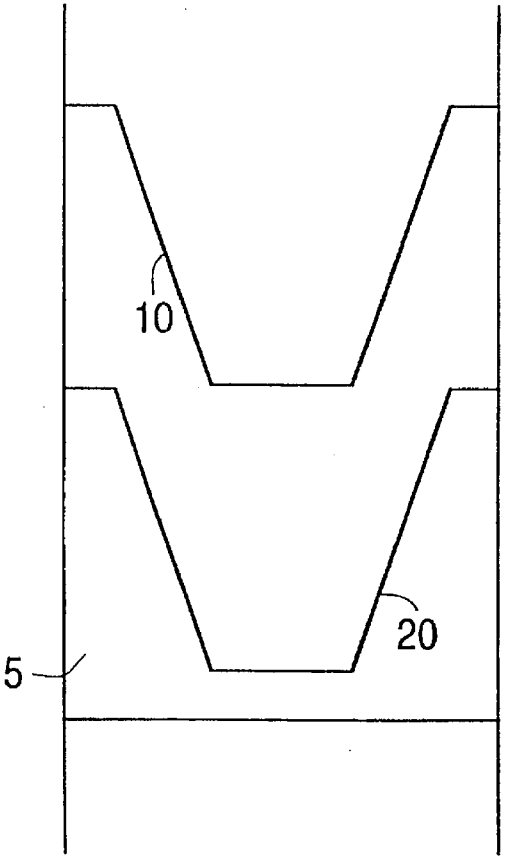

The invention will be properly understood by reading the description of one non-limitative embodiment illustrated by the attached drawings, wherein:

FIG. 1 is a partial cross-sectional view of the pumping system according to the invention;

FIG. 2 is an overall sectional view of a system having four pumping elements disposed in a pumping module specifically designed for offshore production;

FIG. 3 is a schematic view of the hydraulic control of two jacks of the pumping system; and FIGS. 4–6 respectively illustrate positions of the cylinder moving toward the splayed projection of the cylinder head used for providing an explanation of the operational principle producing an increase in velocity of the fluid jet as the piston approaches the cylinder head.

DESCRIPTION OF THE PREFERRED EMBODIMENTS

In FIG. 1, the system of the present invention includes a first pumping element of generally designated by the reference numeral 1, and a second pumping element generally designated by the reference numeral la identical to the first element.

The pumping element 1 comprises a chamber 2 delimited by a cylinder head 3, a cylinder 4, and a piston 5. Piston 5 slides in cylinder 4 by means of a jack generally designated by the reference numeral 6 coupled by rod 7 of jack generally designated by the reference numeral 6 and a pin 8. The piston has sealing mechanism 9 rings or such as lip seals used, for example, in mud pump pistons, which cooperate with cylinder 4 to ensure compression of the multiple phase fluid which has gaseous, liquid and particulate constituents. Cylinder head 3 has a projection 10 located on the axis of the frustroconical cylinder flared or splayed from its base 10*a* such that the cross-sectional area of the projection decreases with increasing distance along the longitudinal axis of the cylinder moving away from the opening of the cylinder which is closed by the cylinder head, and a fluid feed port 11 at the end 10*b* of the projection located farthest from the cylinder head. The outer complementary surfaces of the splayed projection 10 and recess 20 may be defined respectively by a radius which increases along the longitudinal axis of the projection and the recess respectively moving toward the top of the cylinder head 3 and a top of the piston 5. Feed port 11 has a seat which is closed by a valve 12 during the filling phase of chamber 2 in order to allow the multiple phase fluid coming from feed line 13 to penetrate therein.

The multiple phase fluid penetrates the chamber because of the pressure differential on either side of valve 12 which is sufficient to resist the spring return mechanism 14 of valve 12. The fluid, which is compressed when the volume of chamber 2 decreases, escapes from chamber 2 through four discharge ports 15 provided with check valves generally designated by the reference numeral 16 including valve elements 17 cooperating with seats integral with the cylinder head and springs 18 which block the discharge ports during the feed phase of chamber 2. Discharge ports 15 are connected to a discharge line 19.

During the volume reduction of chamber 2 the splayed projection 10 penetrates into recess 20 of the piston having a geometry which is complementary to the geometry of the splayed projection so as to produce a jet of fluid directed at discharge ports 15 which increases in velocity as the piston moves toward the cylinder head. The theory describing the increase in velocity of the fluid jet is described below in conjunction with FIGS. 4–6. The projection 10 is splayed from a minimum cross-section at a point of maximum extension into the chamber upward to a maximum cross-section adjacent to a remainder of the cylinder head. The substantially matching complimentary and frustroconical shapes of recess 20 and projection 10 allow a high-speed jet of the multiple phase fluid, which preferably has an increasing velocity as the piston approaches the head, to be produced which impinges on the walls of recess 20 of piston 5, cylinder head 3 (in particular its projection 10) and cylinder 4, in order to facilitate the discharge of the multiple phase fluid and cleaning of deposits produced, for example, by the particulate constituents within the multiple phase fluid on surfaces 11*a* which would accumulate there in the absence of this advantageous arrangement. The central arrangement of projection 10 and recess 20 also allows distribution of the fluid, as soon as it is introduced into the chamber which is favorable to its compression.

Jack 6 is connected through two openings 21 and 22 to hydraulic generators designed to produce movements of the jack and variations in the volume of chamber 2.

Pumping element 1 of the pumping system also has a casing, identified by reference numeral 23, which surrounds the space swept by piston 5 and is opposite chamber 2 with respect to piston 5, as well as the free space volume between the piston and the body or fixed part of jack 6.

This casing 23 communicates with similar casing 23*a* of pumping element 1*a*. Casings 23, 23*a*, etc. of the elements contain gaseous fluid whose pressure is designed in particular to reduce or even eliminate leaks of multiphase fluid between chamber 2 and the casing and/or to decrease the thickness of casing or casings 23, 23*a*, etc. which must withstand any hydrostatic pressure from the environment surrounding the pumping system. Thus, in offshore oil production, this outside pressure may be that produced by a column of sea water 1000 meters deep.

In an often highly advantageous manner, this pressure may be that of the feed line or that of the discharge line.

The casing may be connected to, or traversed by, one or other of these lines 100 (FIG. 1). Leakages of fluid between chamber 2 and casing 23 may then be mixed with the pumped fluid or the fluid to be pumped.

It is thus possible to pressurize the casing to a pressure approximately the same as the outside pressure; however, leaks of gas from the casing to the pumping chamber make it necessary to renew the gas. This renewal requires, when the system is used under water at great depths, a gas generator which complicates the operation of the system and reduces its reliability.

FIG. 2 is a pumping system including four elements and disposed in a pumping module which can be submerged at the bottom of the sea, for example at a depth of 100 meters.

Pumping module generally designated by the reference numeral 25 is designed to be positioned on a base 26 by four guideposts integral with the base, cooperating with guide cones integral with the module. The lowering of this module onto the base is guided by guidelines installed at the tops of the posts, so that the lines cooperate with the guide cones.

In the middle of these four guideposts is disposed a connector 27 traversed by a feed line of the pumping system, and which comes from the wellhead or a group of wellheads and by the pumped fluid discharge line which rises to the surface of the water directly or after crossing the sea bed for some distance. This connector 27 cooperates with a collar 28 integral with pumping module 25. It is also possible, as shown in FIG. 1, for the casing 23 to be closed and communicate only with the discharge line 19 by a connector line 100.

From collar 28, feed line 13 rejoins casing 23 of the first pumping element. The pumped multiphase fluid passes through casings 23 and 23*b* of a third pumping element as well as assembly flange 24 before being guided by line 13 to a distribution box 29 which divides the fluid into each of the pumping chambers.

Once the multiphase fluid has been pumped, the fluid leaves the various chambers through pipes 19, and collects in various collecting boxes 30, 31 before being sent, still through the discharge line, to collar 28 and connector 27.

The pumping module also has a hydraulic plant 32, an electrohydraulic container 33, a flexible tank 34, and an electronic container 35, all located under the pumping chambers between the jack bodies.

Hydraulic plant 33 converts electrical power provided from above the water surface into hydraulic energy, allowing the four jacks (6, 6*a*, 6*b*, and the jack not shown).

Electrohydraulic container 32 ensures distribution of the hydraulic fluid between hydraulic plant 33 and jacks 6, 6*a*, 6*b*, and the jack not shown.

Flexible tank 34 serves as an expansion chamber and a hydraulic fluid storage tank.

Electronic container 35 includes the control and measuring circuits of the various sensors and pumping module valves. Container 35 contains in particular the control circuits for the jack movements, the valve openings and closings, and the electronic circuits of the pressure, temperature, flowrate, and contamination sensors.

The upper part of the module contains a shield 36 ensuring protection of the module against the fall of objects such as drill rods. The tapered shape of shield 36 allows concave part 37 to be used as a hydrocarbon trap to control contamination. Shield 36 is surmounted by a connector 38 which holds it and manipulates the pumping module by a cable or string of rods. The attachment of the various elements of the module and its stiffness are ensured in particular by support tubes 39 and platforms 40, 41, 42.

FIG. 3 shows schematically the hydraulic control of the two jacks 6, 6*a* associated with the control system.

The jacks of the system are matched such that the pressure in the casing does not vary when there are variations in the volume of fluid therein, with the volume variations being produced by the movement of the pistons in the cylinders.

The hydraulic plant includes a high-pressure hydraulic generator 50 which may be variable-flow but which operates at constant flow for given multiphase fluid production conditions. This generator 50 supplies the hydraulic energy (1 MW) necessary for fluid to be pumped during the compression-discharge phase.

The plant also has a hydraulic generator 51 whose flowrate may vary but which is used at constant flow for the aforementioned production conditions. This generator 51 furnishes the hydraulic energy needed for supply chambers 67 to retract the jack rod and increase the volume of the chambers.

A control hydraulic generator 52 furnishes the fluid needed for controlling the distribution of hydraulic fluid to the jacks. These three generators, 50, 51, and 52, are driven by a motor 53 located in an enclosure which has the same pressure as the hydraulic plant 32 where it is located.

Each of these generators 50, 51, 52 is provided with a filter which has a safety bypass 50*a*, 51*a*, 52*a* respectively and with a differential valve 50*b*, 51*b*, 52*b* to limit the discharge pressure. Intake to these pumps is through a filter 54 which has a safety bypass in the enclosure of hydraulic plant 32 which serves as a rigid tank for the hydraulic fluid.

This rigid tank is connected to a flexible tank 55 disposed in container 34.

Each of jacks 6, 6*a* has an end-of travel sensor 56, 56*a*, 57, 57*a*, of the magnetic type for example, the sensors allow the movements of the jacks with respect to each other to be controlled.

Sensors 56, 56*a*, 57, 57*a* are connected electrically by line 58 to control center 59. Center 59, which is supplied with hydraulic fluid by pump 52 and chamber 60 branching off from the pump, controls the operation of distributors 61, 62, 63, 64 by a hydraulic outlet 65.

These distributors are of the fast-switching type in order to avoid the water hammer which would be brought about by the changes in movement of the jacks.

The distributors cause the chambers of each of the jacks to communicate alternately with return 66 to the tank and either high-pressure generator 50 or low-pressure generator 51.

The control center switches the distributors when the two jacks have reached the end of travel, as detected by sensors 56, 67, 56*a*, 57*a*.

FIG. 3 shows schematically the control operation during extension of jack 6 and retraction of jack 6*a*, whereby upper chamber 67 of jack 6 empties into return 66 to the tank, lower chamber 68 of jack 6 fills with the fluid from high-pressure generator 50, upper chamber 67*a* of jack 6*a* fills with the fluid from low-pressure generator 51, and lower chamber 68*a* of jack 6*a* empties into return 66 to the tank.

When jack 6 is completely extended and jack 6*a* completely retracted, the control center causes distributors 61, 62, 63, 64 to switch such that upper chamber 67 is fed by low-pressure generator 51, lower chamber 68 empties into return 66, upper chamber 67*a* empties into return 66, and lower chamber 68*a* is fed by high-pressure generator 51.

When jack 6 is completely retracted and jack 6*a* completely extended, the center controls switching of distributors 61, 62, 63, 64 which are in the arrangement shown schematically in FIG. 3.

Return 66 to the tank is provided with a filter 69 having a safety bypass and an exchanger 70 designed to cool the hydraulic fluid.

FIGS. 4–6 illustrate respectively three positions of the piston 5 relative to the cylinder head 3 during movement of the piston toward the cylinder head. During this movement, the volume of the chamber decreases which increases the speed of the multiphase fluid during movement of piston 5 toward the cylinder head 3 which produces the high speed jet of the multiple phase fluid which increases in velocity as a function of the decrease in the aforementioned annular surface area. The high speed jet of increasing velocity both removes deposits and prevents deposits from forming on the bottom of the chamber which are harmful to proper operation of the pumping system.

FIG. 5 illustrates a first reduction of volume of ΔV the chamber 2 caused by projection of the protrusion 10 into the recess 20. The volume of chamber decreases by the first value ΔV corresponding to the volume of the splayed protrusion 10 having penetrated in the chamber in a time $t_1$ as defined by the following equation:

$$\Delta V = \left(\frac{1}{3}\right)\pi h_1(r^2 + rr' + r^2)$$

with $h_1$=the height of the protrusion 10 having penetrated the chamber 2 and corresponding to the displacement of the piston 5, r=radius of the lower part of the protrusion, r'=radius of the part of the protrusion corresponding to the height $h_1$.

At this variation of volume ΔV, a value of the output of flow Q is expressed by the following equation:

$$Q = \frac{\Delta V}{t_1} = \frac{1}{3}\pi(r^2 + rr' + r^2)\frac{h_1}{t_1}$$

with speed of displacement $V_1$ of the piston being defined by the following equation:

$$V_1 = \frac{h_1}{t_1}$$

An annular section is defined by the internal wall of the piston 5 and the shape of the complementary-shaped protrusion 10.

The axial speed of the fluid in this annular section ($r_1$, r') is defined by the following equation:

$$V = \frac{Q}{S} = \frac{1}{3}\pi\frac{(r^2 + rr'^2 + r'^2)}{\pi(r^2 - r'^2)}$$

This equation demonstrates that the axial speed of the fluid increases with an increase of the value of r' depending on the shape of the protrusion.

FIG. 6 illustrates a further reduction of volume ΔV' of the chamber 2 caused by projection of the protrusion 10 into the recess 20. FIG. 6 is used to show that in the course of the penetration of the protrusion 10 into the recess 20 of the piston 5 the axial speed of the multiphase fluid increases.

The supplementary decrease in volume of the penetration of the protrusion 10 inside the recess 20 is expressed by the equation:

$$\Delta V' = \frac{1}{3}\pi h_1(r'^2 + r'r'' + r''^2)$$

when r">r' and r">r then ΔV' is greater than ΔV.

Assuming that $V_1$ is constant:

1) then the axial speed of the multiphase fluid in the annular section as previously mentioned ΔV' is greater than corresponding to ΔV.

2) Moreover, the section of passage of the multiphase fluid between the wall of the recess 20 of the pistons and the protrusion 10 of the head 3 has decreased in the course of penetration.

Then the speed of the multiphase fluid in the annular section corresponding to $\pi(r_1^2 - r''^2)$ has increased because, as mentioned above, $$V = \frac{Q}{S}.$$

From the previous explanation, it can be seen that the value of the speed of the fluid depends on the value r, r', r", $r_1$, and on the shape of the protrusion 10 of the multiphase head 3.

Moreover, the highest value of the speed of the multiphase fluid is obtained with the parameter r' is greatest defining in part that the volume of the head 3 has penetrated farthest in the recess 20 of the piston 5.

Then, the largest cross-sectional part of the protrusion 10 must be positioned at the top of the head as illustrated in FIG. 1.

A second hypotheses is that the speed of displacement of the piston 5 may decrease, for example, at the end of the course stroke of the piston.

The fluid volume is defined by the protrusion 10 and the internal wall of the recess 20 and the multiphase fluid comprises a gaseous phase and a liquid phase which are separated by an interface. In the course of the displacement of the piston 5 inside the recess 20, the impact of the piston on this interface allows the solid particles to be agitated, these latter being suspended in the fluid, and the speed of the fluid is still enough to allow the evacuation of the solid particles.

In relation to the examples described on FIGS. 5 and 6, a ratio of the speed of the fluid in the annular space for two positions is defined by the following equation:

This ratio is always >>1 when $r_1 > r'' > r' > r$.

$$\frac{V_1}{V_2} = \left(\frac{r'^2 + r'r'' + r''^2}{r^2 + rr' + r'^2}\right)\left(\frac{r_1^2 - r'^2}{r'^2_1 - r''^2}\right).$$

Then, this confirms that the shape of the protrusion 10 must be splayed with the largest section situated on the surface of the head 3, and that this is an important characteristic of the present invention.

In this way, a decrease of the annular cross-sectional area in the course of penetration of the protrusion 10 inside the recess 20 of the piston 50 produces a jet of fluid which preferably increases in speed as the multiphase fluid is evacuated during the upward stroke of the piston 5.

What is claimed is:

1. A device for pumping a multiphase fluid having a liquid phase and a gas phase, the device comprising a feed line for feeding the fluid to be pumped, a discharge line for discharging pumped fluid, at least one variable-volume chamber for pumping said fluid, said chamber being defined by a cylinder head, a cylinder, and a piston movable in the cylinder along a longitudinal axis of the cylinder, said piston having a recess facing an upper part of the piston, said cylinder head including a projection having a cross-sectional configuration matching a cross-sectional configuration of said recess so as to enable said projection to penetrate into said recess when said piston approaches said cylinder head with the projection being splayed and the cross-section of the projection being largest adjacent to a remainder of the head facing the chamber and a valve means provided in said projection for controlling a feed of the multiphase fluid from said feed line into said at least one variable volume chamber, and wherein, when said projection penetrates into said recess of said piston, cooperating surfaces of said projection and said recess produce a high speed jet of multiphase fluid directed directly toward at least one discharge port for discharging said multiphase fluid.

2. A device according to claim 1, wherein said recess and said projections have substantially matching frustoconical shapes.

3. A device according to claim 1, wherein said recess and said projection are disposed in a vicinity of the longitudinal center axis of said cylinder.

4. A device according to claim 1, wherein said chamber has a fluid feed port disposed at one of said projections.

5. A device according to claim 1, wherein said cylinder head has at least two discharge ports located at substantially equal distances from the longitudinal center axis of said cylinder.

6. A device according to claim 1 further comprising a casing surrounding at least a space traversed by the piston, said space being located opposite said chamber with respect to said piston, and wherein said casing contains a gaseous fluid.

7. A device according to claim 6, wherein said casing is closed and communicates only with said feed line.

8. A device according to claim 6, wherein said casing is closed and communicates only with said discharge line.

9. A device according to claim 6, wherein said casing is fluid-tight.

10. A device according to claim 1, wherein several pumping chambers are provided, and wherein a number of said pumping chambers is an even number.

11. A device according to claim 1 further comprising at least one first drive element for moving said piston in said cylinder and wherein the multiphase fluid includes petroleum effluent.

12. Device according to claim 11 wherein said device is located at a bottom of an aqueous medium or in a hostile terrestial environment.

13. A device according to claim 1 wherein:

the means for producing a jet of the multiphase fluid produces a jet with increasing velocity as said piston moves toward said head.

14. A device according to claim 13 wherein:

the jet evacuates deposits out of the chamber.

15. A device according to claim 1 wherein:

the jet evacuates deposits out of the chamber.

16. A device according to claim 1 wherein:

the recess and the projection respectively each have an outer surface which is defined by an increasing radius measured from a longitudinal axis of the recess and a longitudinal axis of the projection.

17. Device according to claim 1 further comprising at least one first drive element for moving said piston in said cylinder.

18. Device according to claim 17 wherein the first drive element being a first hydraulic jack.

19. Device according to claim 18, further comprising a second variable-volume chamber for pumping said fluid, said second chamber being defined by a second cylinder head, a second cylinder, and a second piston, said second piston being movable in said second cylinder along a longitudinal axis of said second cylinder, said casing also surrounding the space traversed by said second piston, wherein the space traversed by said second piston is opposite to said second chamber with respect to said second piston, and wherein movements of at least said first and second piston are controlled so that the piston of said fluid in said casing is substantially constant.

20. Device according to claim 19, further comprising a second hydraulic jack, said first hydraulic jack being integral with said first piston, said second hydraulic jack being integral with said second piston, means for controlling the first and the second hydraulic jacks in such a manner so as to reduce the volume of the first chamber while increasing the volume of the second chamber and so as to reduce the volume of the second chamber while increasing the volume of the first chamber alternately.

21. Device according to claim 20, wherein said control means triggers the increase in volume of one of the two chambers only if the other of the two chambers has reached its maximum volume, and wherein said control means triggers a reduction in the volume of one chamber only if the other of the two chambers has reached a maximum volume.

22. Device according to claim 21, further comprising a high-pressure generator supplying a hydraulic fluid at high pressure and a low-pressure generator supplying a hydraulic fluid at a pressure less than said high pressure, said high-pressure generator supplying each of said hydraulic jacks when said hydraulic jacks are producing a reduction in volume of their respective chambers, said low-pressure generator supplying each of said hydraulic jacks when they are producing an increase in volume of their respective chambers.

23. Device according to claim 20, wherein at least one of the first or the second hydraulic jacks includes a body, and wherein said body is at least partially disposed outside a casing of the device.

24. A device for pumping multiphase fluid, the device comprising a feed line for feeding the multiphase fluid to be pumped, a discharge line for the multiphase pumped fluid, at least one variable-volume chamber for pumping said multiphase fluid, said variable-volume chamber being defined by a cylinder head, a cylinder and a piston, whereby the piston moves along a longitudinal axis of the cylinder, said piston having a recess facing an upper part of the piston, and said cylinder head including a projection penetrating into said recess when said piston approaches said cylinder head with the projection being splayed and the cross-section of the projection being largest adjacent to a remainder of the head facing the chamber, said piston and said projection cooperating to produce a jet of multiphase fluid directed directly toward at least one discharge port for discharging said multiphase fluid, said chamber including a fluid feed port communicating with said feed line and with said variable-volume chamber, said feed port being disposed at one tip of said projection, said cylinder head having at least two discharge ports located at substantially equal distances from the longitudinal axis of said cylinder and valve means within the projection for controlling a feed of the multiphase fluid from said feed line into said at least one variable volume chamber.

25. A device according to claim 24 wherein:

the means for producing a jet of the multiphase fluid produces a jet with increasing velocity as said piston moves toward said head.

26. A device according to claim 25 wherein:

the jet evacuates deposits out of the chamber.

27. A device according to claim 26 wherein:

the recess and the projection respectively each have an outer surface which is defined by a radius which increases along a longitudinal axis of the projection and the recess respectively moving toward a top of the cylinder head and a top of the piston.

28. A device according to claim 24 wherein:

the jet evacuates deposits out of the chamber.

29. A device for pumping multiphase fluid having liquid phase, a gas phase and a solid phase including solid particles, the device comprising a feed line for feeding the fluid to be pumped, a discharge line for discharging pumped fluid, at least one variable volume chamber for pumping the fluid, each chamber being defined by a cylinder head, a cylinder and a piston movable in the cylinder, the piston having a recess facing an upper part of the piston, the cylinder head including a protrusion penetrating into the recess when the piston is moving toward the cylinder head when the piston is in proximity to the head, each chamber having at least one fluid supply orifice, the piston and the head having complementary cooperating shapes for producing a jet of fluid when the piston moves toward the head when the piston is in proximity to the head which is directed towards at least one discharge orifice for the multiphase fluid, the protrusion having a splayed shape at least over a part of a height of the protrusion with a largest cross-section of the part being located closest to the head.

30. A device in accordance with claim 29 wherein:

the complementary shapes define an annulus which decreases in surface area as the piston moves toward the cylinder head when the projection extends in part into the recess to produce the jet of the multiple phase fluid which increases in velocity as the annulus decreases in surface area.

31. A device according to claim 30 wherein:

the jet evacuates deposits out of the chamber.

32. A device according to claim 29 wherein:

the jet evacuates deposits out of the chamber.

33. A device in accordance with claim 29 wherein:

the recess and the protrusion respectively each have an outer surface which is defined by a straight line of rotation.

* * * * *